US005947535A

United States Patent [19]

Baker

[11] Patent Number: 5,947,535

[45] Date of Patent: Sep. 7, 1999

[54] DUAL MOTION, QUICK RELEASE LATCH MECHANISM

[76] Inventor: John R. Baker, 841 A Stanley Ave., Evansville, Ind. 47711

[21] Appl. No.: 08/942,065

[22] Filed: Oct. 1, 1997

Related U.S. Application Data

[60] Provisional application No. 60/028,889, Oct. 18, 1996.

[51] Int. Cl.[6] ..... E05C 1/12

[52] U.S. Cl. ..... 292/165; 292/169; 292/169.14; 292/336.5; 70/468; 70/471

[58] Field of Search ..... 292/169, 165, 292/169.14, 169.15, 166, 336.5, 336.3, DIG. 52, 179, 302, 348, 352; 70/467, 468, 471, 481, 482, 487, 489, 483

[56] References Cited

U.S. PATENT DOCUMENTS 908,361 12/1908 Vredenburgh et al. ..... 70/153
1,792,154 2/1931 Farmer ..... 292/170
5,026,101 6/1991 Dotterweich et al. ..... 292/166
5,437,174 8/1995 Aydin ..... 70/278
5,516,163 5/1996 Baker ..... 292/169
5,611,581 3/1997 Ghostly ..... 292/165
5,715,715 2/1998 Nunez ..... 70/283

*Primary Examiner*—Steven Meyers
*Assistant Examiner*—John B. Walsh

[57] ABSTRACT

A latch mechanism which includes exterior and interior handle assemblies connected by a bar with a cammed surface such that the latch mechanism can be actuated by pushing, pulling, or turning a handle. Pushing or turning the exterior handle causes the bar to contact a cam follower on a receiver whose edge will rotate a lever to retract a bolt. Also, pulling or turning the interior handle produces the same result. Once the bolt is retracted, and the handle is released, a spring biases the bolt back to the extended position.

20 Claims, 9 Drawing Sheets

19
18
17
17B
E
17D
18A
17B
19
F 30
31A
31
D
30B
30A
C
30D
5D
5A
B
5B
5
5C
A
5E
10A
D
10B
10F
C
10H
10E
10G
10
10C
10D
E
F
6A
6
9
B
9B
9A
12A
3
2A
12
F
11
13A
7A
7B
7
8
2
E
A
2F
4
13A
16
16A
16B
21
E
20B
20A
F
20

DUAL MOTION, QUICK RELEASE LATCH MECHANISM

CROSS REFERENCES TO RELATED APPLICATIONS

Provisional Application No. 60/028,889 filing date Oct. 18, 1996

STATEMENT AS TO RIGHTS TO INVENTIONS MADE UNDER FEDERALLY SPONSORED RESEARCH AND DEVELOPMENT

Not applicable

BACKGROUND OF THE INVENTION

FIELD OF THE INVENTION

The present invention is an improvement over the U.S. Pat. No. 5,516,163, May 14, 1996, John R. Baker, "Single Motion, Quick Release Latch Mechanism". The present invention is a latch mechanism such as would be usable as a door latch mechanism, that is actuated either by pushing or pulling a handle or a knob, as in the prior art, or by a turning motion. This provides an improved means of entry into or exit from a room. One of the preferred embodiments of the present invention includes a locking mechanism.

BACKGROUND INFORMATION

Most door latch mechanisms are actuated by turning a knob or a handle. As discussed in Baker U.S. Pat. No. 5,516,163, those types of door latch mechanisms were a problem for many people. Baker U.S. Pat. No. 5,516,163, was an improvement in that the Baker latch mechanism could be actuated relatively easily by pushing or pulling a handle or a knob. In a panic situation, this works well. However, in a non-panic situation, people are accustomed to turning a handle or a knob when opening a door. As Baker U.S. Pat. No. 5,516,163 did not actuate by turning, this could be an obstacle to customer acceptance. As will be seen in the subsequent description, the present invention is an improvement over Baker U.S. Pat. No. 5,516,163, Single Motion, Quick Release Latch Mechanism.

SUMMARY

The present invention is a latch mechanism, such as may be found in a door, which is actuated either by pushing or pulling or turning a handle or a knob. One of the preferred embodiments of the present invention includes a locking mechanism.

DESCRIPTION OF THE PREFERRED EMBODIMENTS

Figure 1:
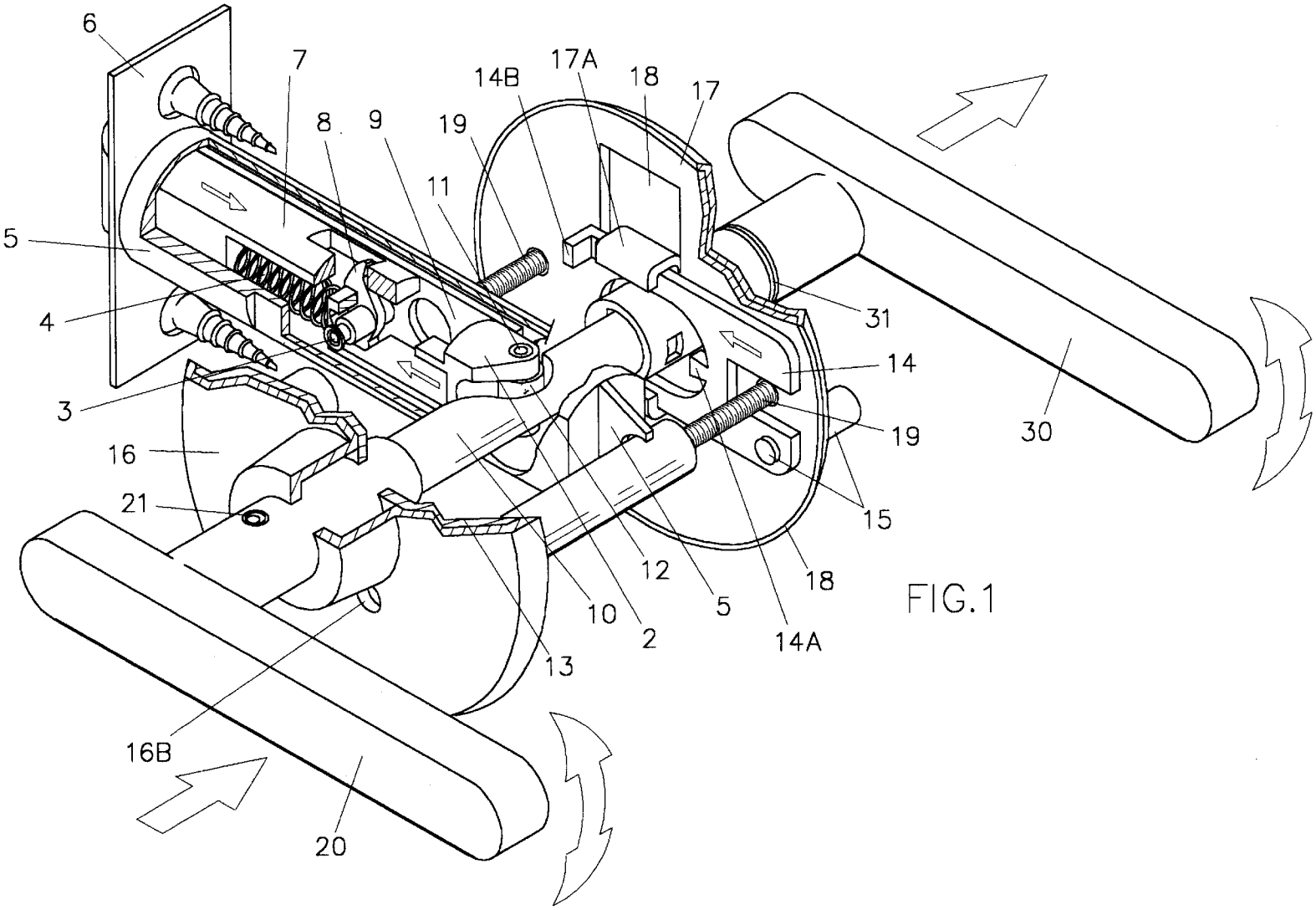
FIG. 1 shows the present invention including a locking mechanism.

Referring to FIGS. 1 through 5A, the present invention, a latch mechanism, comprises a receiver 2, a barrel housing rivet 3, a spring 4, a barrel housing 5, a barrel housing end plate 6, a bolt 7, an internal lever 8, an internal stationary plate 9, a bar 10, a stationary pin 11, a rotating cam follower 12, an exterior handle inner plate 13, a lock plate 14, a lock knob 15, an exterior handle outer plate 16, an interior handle inner plate 17, an interior handle outer plate 18, screws 19, an exterior handle 20, a pin 21, an interior handle 30, and a locking ring 31.

The barrel housing 5 includes two in-line barrel housing apertures 5A, two in-line barrel housing internally threaded stud clearances 5B, a barrel housing flange 5C, a barrel housing bracket 5D, and two in-line barrel housing rivet apertures 5E.

Figure 2:
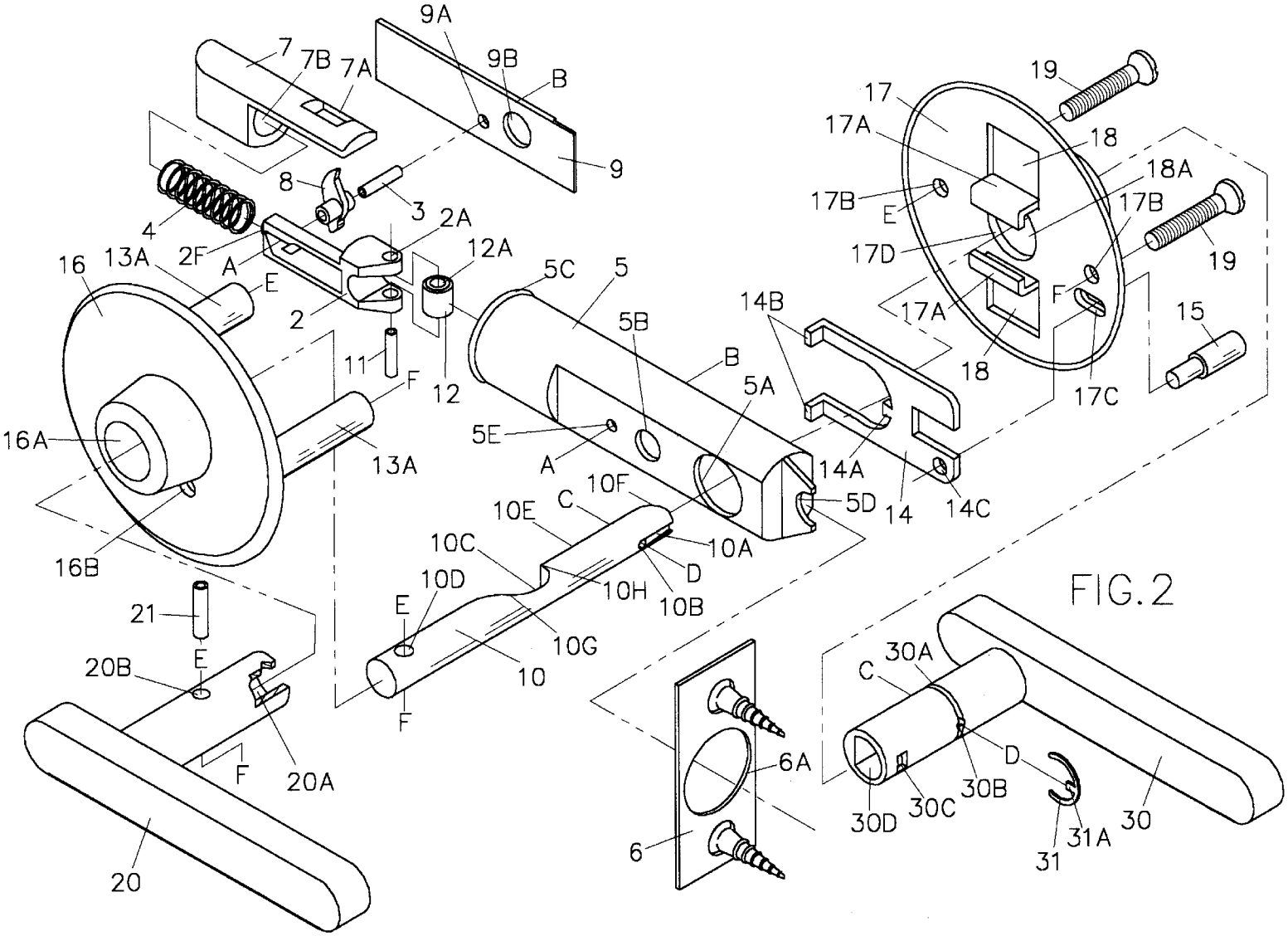
FIG. 2 is an exploded view of the present invention with the locking mechanism.
Figure 4:
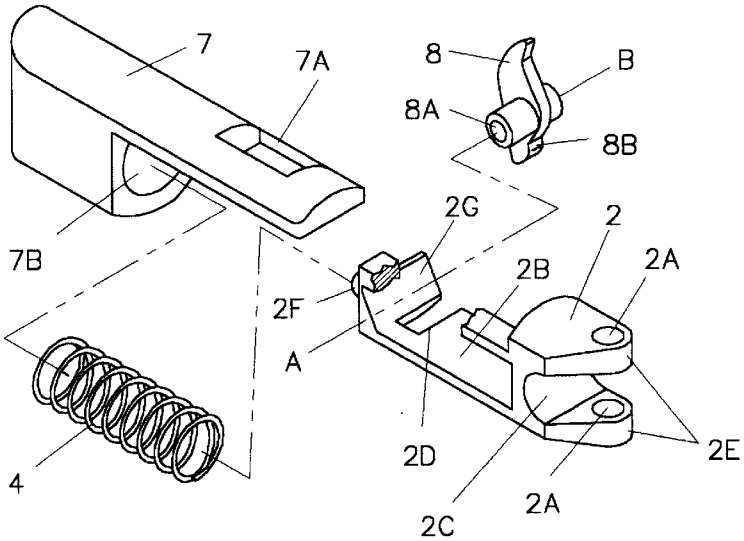
FIG. 4 shows an enlarged view of some of the parts used in the present invention.

Referring to FIGS. 2 and 4, the receiver 2 includes two receiver apertures 2A, a receiver slot 2B, a receiver clearance 2C, a receiver edge 2D, two lugs 2E, a projection 2F, and a stop 2G.

The rotating cam follower 12 includes a stationary pin aperture 12A. The rotating cam follower 12 is retained in the receiver 2 by means of a stationary pin 11 through the stationary pin aperture 12A and the receiver apertures 2A. The stationary pin 11 can be staked or adhered in position, or threaded and then screwed into place, or however required to secure the rotating cam follower 12 in the receiver 2 so the rotating cam follower 12 rotates freely around the stationary pin 11.

The bolt 7 includes a bolt lever slot 7A and a bolt recess 7B. One end of the spring 4 is contained within the bolt recess 7B while the other end of the spring 4 abuts against the receiver 2. The projection 2F keeps the spring 4 from slipping off of the receiver 2.

The internal lever 8 rotates about the barrel housing rivet 3 which inserts through an internal lever aperture 8A in the internal lever 8. As shown in FIG. 4, an ear 8B of the internal lever 8 abuts against the receiver edge 2D. If the barrel housing 5 is plastic, then an internal stationary plate 9, of steel, which includes an internal stationary plate barrel housing rivet aperture 9A and also a internal stationary plate stud clearance 9B is used to reinforce the barrel housing 5. The internal stationary plate 9 is not needed if the barrel housing 5 is of steel. The barrel housing rivet 3 is normally headed at both ends. The barrel housing rivet 3, normally of steel, can initially be a headed rivet with the other end headed after assembly, or it can start out as a pin that is headed in place, or the heads can be formed by an orbital spinning head which permits heading of pins into rivets while fastening thin materials without distortion. A secure assembly of the barrel housing 5 with its internal components is required for function.

The bar 10 includes an inclined bar tang guide 10A, a bar tang aperture 10B, a saddle 10C, a bar aperture 10D, a bar flat 10E, a bar radius 10F, a bar cam surface 10G, and a bar assembly cam radius 10H.

In the assembly of the present invention, the rotating cam follower 12 is secured into the receiver 2 by means of the stationary pin 11 as previously mentioned. The receiver 2 with the rotating cam follower 12 is secured into the barrel housing 5 by means of the barrel housing rivet 3 through the in-line barrel housing rivet apertures 5E, the internal stationary plate barrel housing rivet aperture 9A, the internal lever aperture 8A, and the receiver slot 2B. As mentioned previously, if the barrel housing 5 is plastic, then the internal stationary plate 9 would be required to reinforce the barrel housing 5. The preferred material of the internal stationary plate 9 is stainless steel, both for strength and non-corrosive properties.

The internal lever 8 includes an ear 8B which abuts against the receiver edge 2D. The internal lever 8 rides inside the bolt lever slot 7A of the bolt 7. The spring 4 is retained between the receiver 2, and the bolt 7 within the bolt recess 7B. The bar 10 is inserted through the in-line barrel housing apertures 5A of the barrel housing 5. The purpose of the bar radius 10F and the bar flat 10E is to facilitate the insertion of the bar 10 past the rotating cam follower 12 which has the spring 4 forcing the receiver 2 with the rotating cam follower 12 against the bar 10. The purpose of the bar assembly cam radius 10H is to serve as a ramp so the rotating cam follower 12 is eased into position at the saddle 10C, as opposed to an abrupt transmission of the rotating cam follower 12 from the bar flat 10E to the saddle 10C. The bar assembly cam radius 10H also permits disengagement of the bar 10 from the barrel housing 5.

When the bar cam surface 10G is in contact with the rotating cam follower 12, the bar cam surface 10G exerts force against the rotating cam follower 12. As the bar 10 is moved linearly into the barrel housing 5, the bar cam surface 10G displaces the rotating cam follower 12 which in turn displaces the receiver 2 against the spring 4, further compressing the spring 4. The receiver edge 2D forces the ear 8B of the internal lever 8 in such a manner that the internal lever 8 is rotated about the barrel housing rivet 3. As the internal lever 8 is rotated about the barrel housing rivet 3, the internal lever 8, which rides inside the bolt lever slot 7A, is drawing the bolt 7 into the barrel housing 5, further compressing the spring 4 in the process. When the present invention is installed in a door, and the bolt 7 is drawn into the barrel housing 5, and the door is open and the bar 10 is no longer being forced into the barrel housing 5 in a linear motion, the spring 4 continues to force the receiver 2 with the rotating cam follower 12 against the bar cam surface 10G, moving the bar 10 linearly until the rotating cam follower 12 rests in the saddle 10C. The bolt 7 has returned to its extended position with the internal lever 8 resting against a stop 2G.

Prior to inserting the bar 10 into the barrel housing 5, the barrel housing end plate 6 could be affixed to a door, typically by screws, as indicated in the FIGS. 1, 2, 6, 7, 8, and 9. Then, the barrel housing 5 with its internal parts would be inserted through an aperture 6A in the barrel housing end plate 6 until the barrel housing flange 5C abuts the barrel housing end plate 6. Or, this could all be done prior to affixing the barrel housing end plate 6 to the door. The barrel housing end plate 6 can be manufactured as an integral part of the barrel housing 5. The barrel housing end plate 6 is an optional part in that the latch mechanism will function without it. It would be used to add stability to the latch mechanism. It would also be used in retrofit installations, for both stability of the latch mechanism and also as a spacer to fill a void in the edge of the door for cosmetic purposes.

The bar 10 is inserted into the exterior handle 20, through a bar clearance 20A until the bar aperture 10D lines up with a pin clearance 20B in the exterior handle 20. The pin 21 is inserted into the pin clearance 20B through the bar aperture 10D, securing the exterior handle 20 to the bar 10. The pin 21 can be a driven interference fit, or the pin 21 can be a rolled pin, or the pin 21 can be secured in place with an adhesive, or the pin 21 can be a threaded fastener, or any other typical means of securing the exterior handle 20 to the bar 10.

For doors that open inward, one pushes the exterior handle 20, or pulls the interior handle 30 to open a door inward.

For doors that open outward, the exterior handle 20 would be mounted on the interior surface of the door, and the interior handle 30 would be mounted on the exterior surface of the door. One then pulls the interior handle 30 or pushes the exterior handle 20 to open the door outward.

The purpose of the preceding two paragraphs is to illustrate that the Dual Motion, Quick Release Latch Mechanism can be installed in a door so that one pushes or pulls a handle or knob in the direction the door is to be opened.

Figure 3:
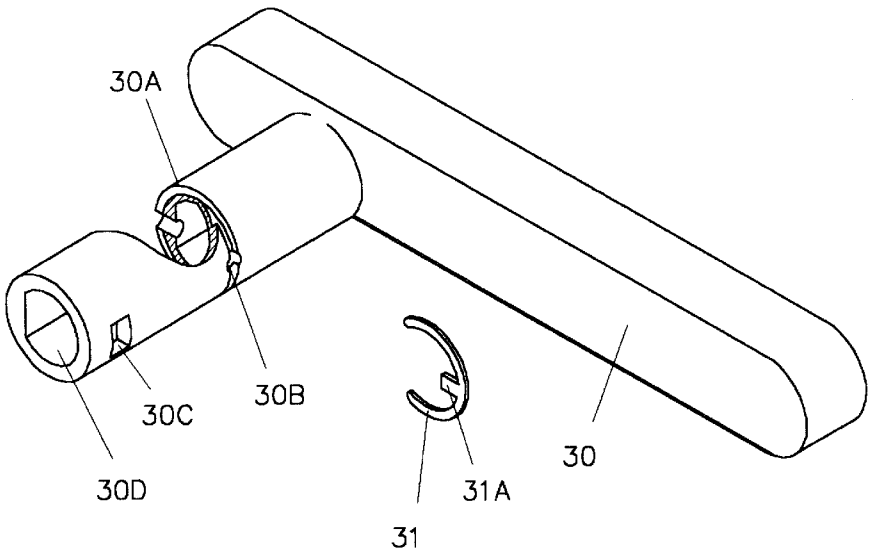
FIG. 3 shows an enlarged view of an interior handle and a locking ring.

As shown in FIG. 3, the interior handle 30 includes a bar clearance 30D which enables the interior handle 30 to contain the bar 10. The interior handle 30 is secured to the bar 10 by the locking ring 31 which has a locking ring tang 31A. The locking ring 31 fits around an interior handle locking ring clearance 30A, with the locking ring tang 31A going through the interior handle aperture 30B and seating in the bar tang aperture 10B. Normally, the locking ring 31 is assembled to the interior handle 30, into the interior handle locking ring clearance 30A, and then the bar 10 is inserted into the bar clearance 30D.

Figures 5, 5A:
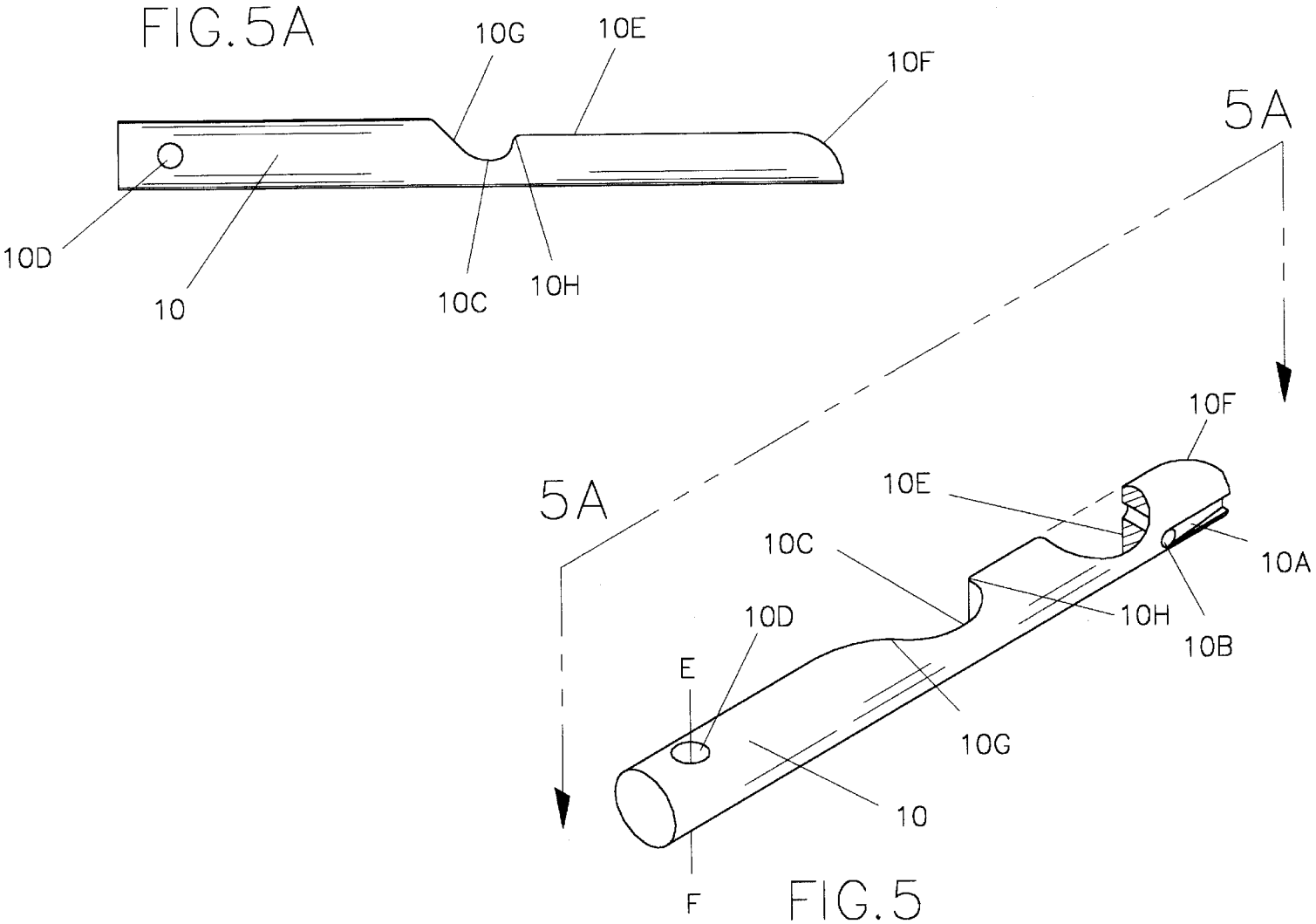
FIG. 5 shows an enlarged view of a bar used in the present invention.
FIG. 5A shows a plan view of the bar from FIG. 5.

As shown in FIG. 5, the inclined bar tang guide 10A is sloped so that the bar 10 can be inserted into the interior handle 30 so the locking ring tang 31A can be engaged into the bar tang aperture 10B.

Figure 10:
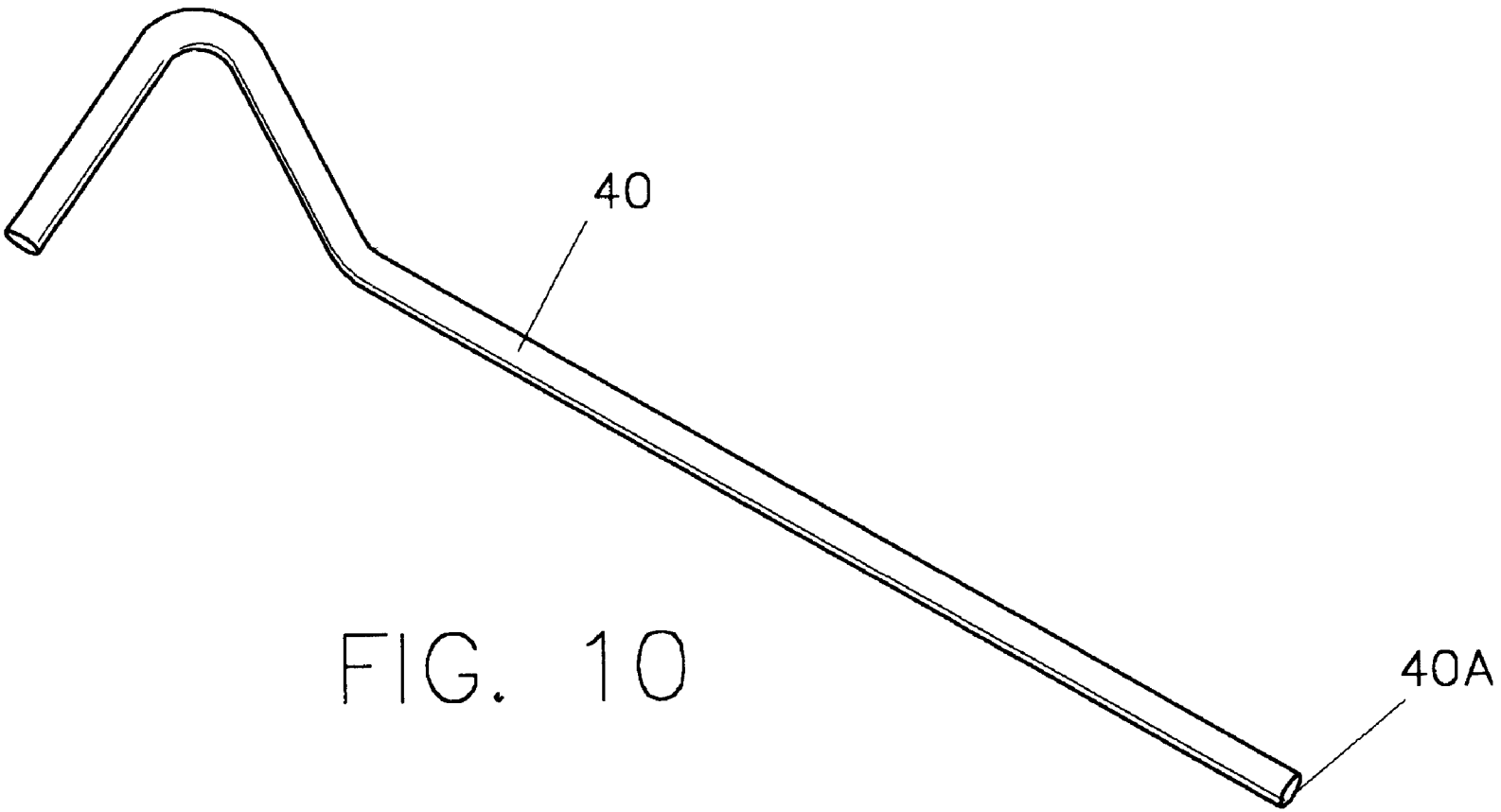
FIG. 10 shows a means of unlocking the present invention.

Referring to FIGS. 3, 5 and 10, a part 40 with a part end 40A can be used to disconnect the locking ring tang 31A from the bar tang aperture 10B and also the interior handle aperture 30B, so the bar 10 can be removed from the interior handle 30.

Figure 8:
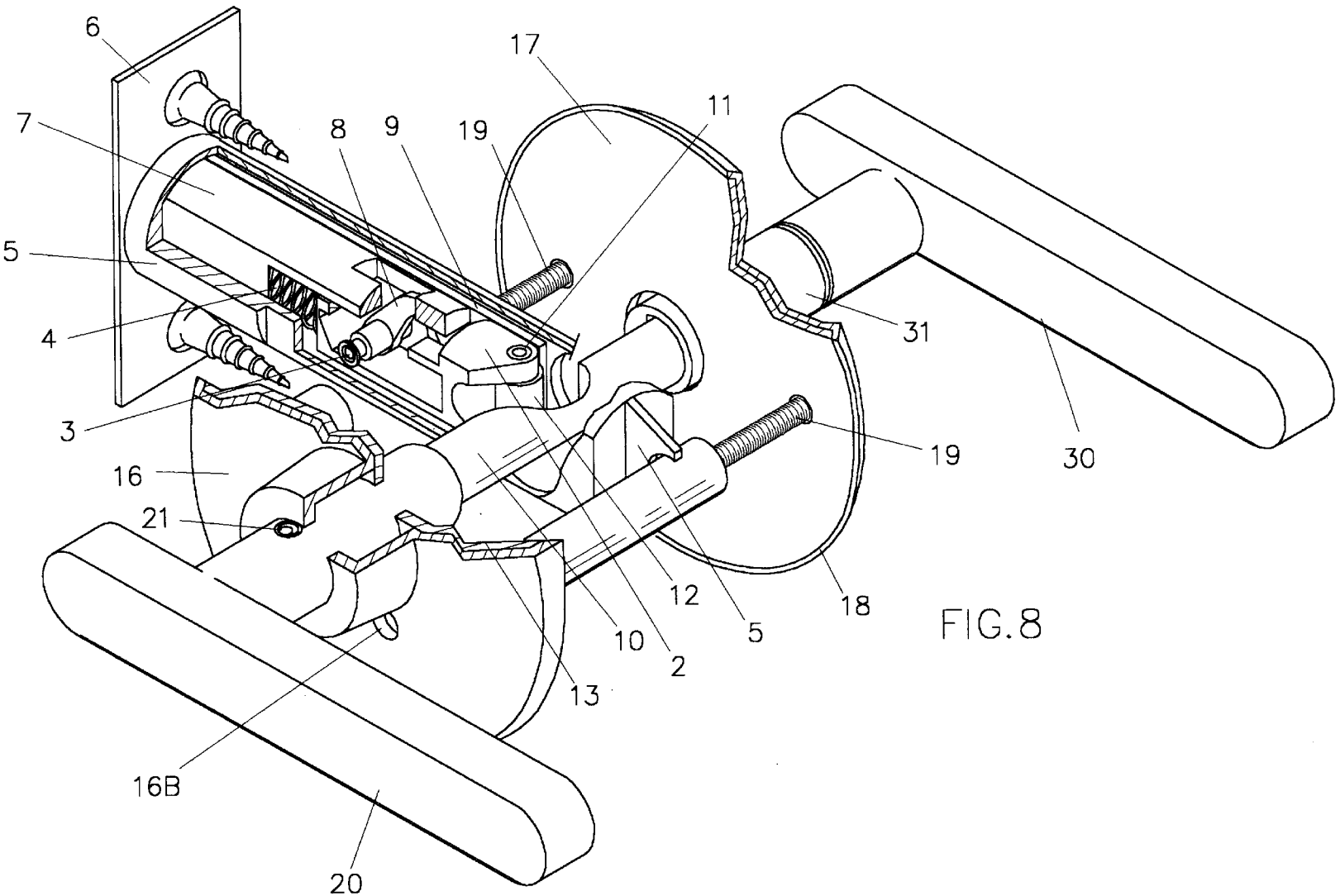
FIG. 8 shows the present invention with a bolt retracted by a linear motion of a handle.

As shown in FIG. 8, when the present invention is installed in a door, and one opens the door by pushing the exterior handle 20 or pulling the interior handle 30, the bar cam surface 10G is pulled into the rotating cam follower 12 thus actuating the latch mechanism.

Figure 6:
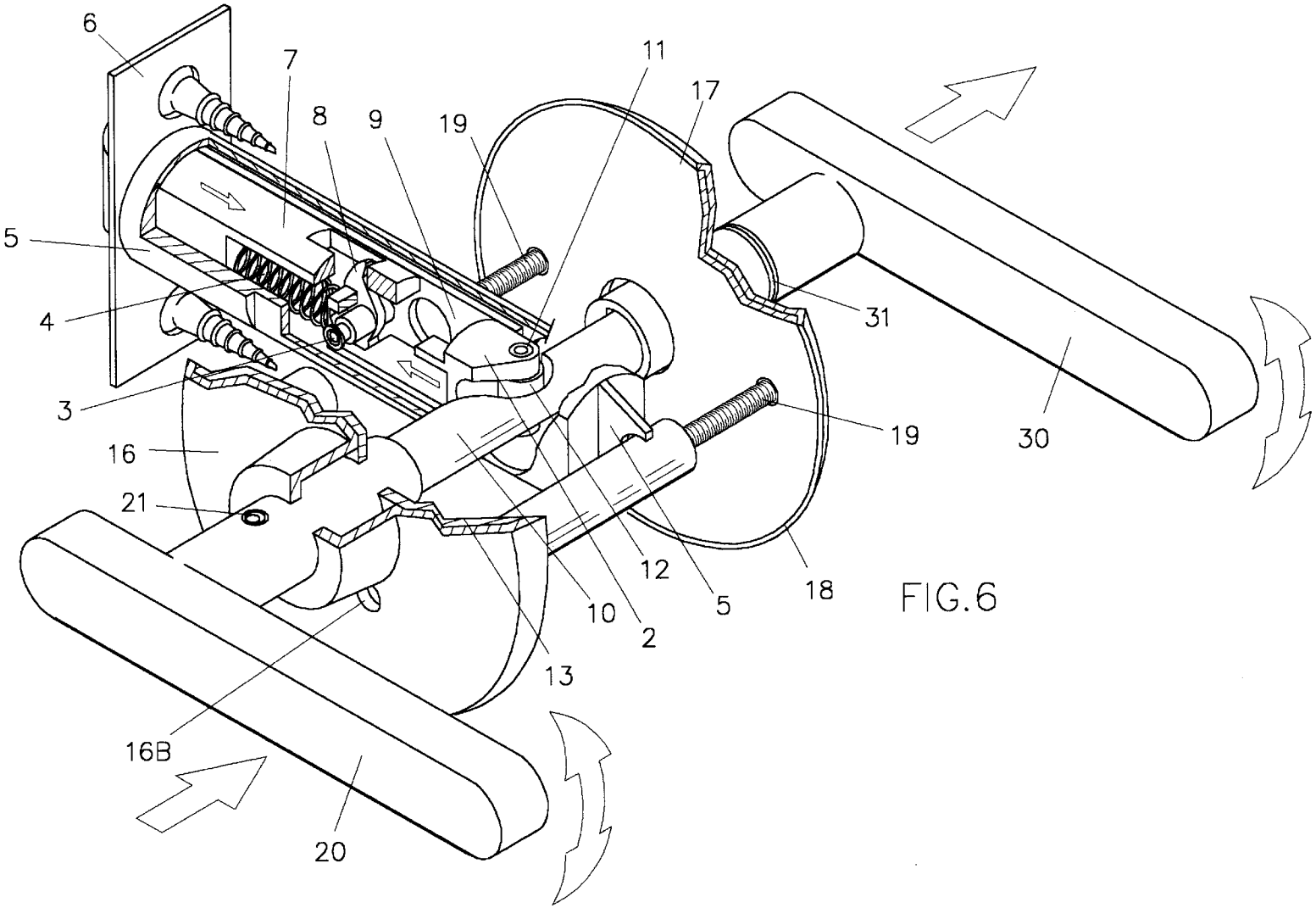
FIG. 6 shows the present invention without a locking mechanism.
Figure 7:
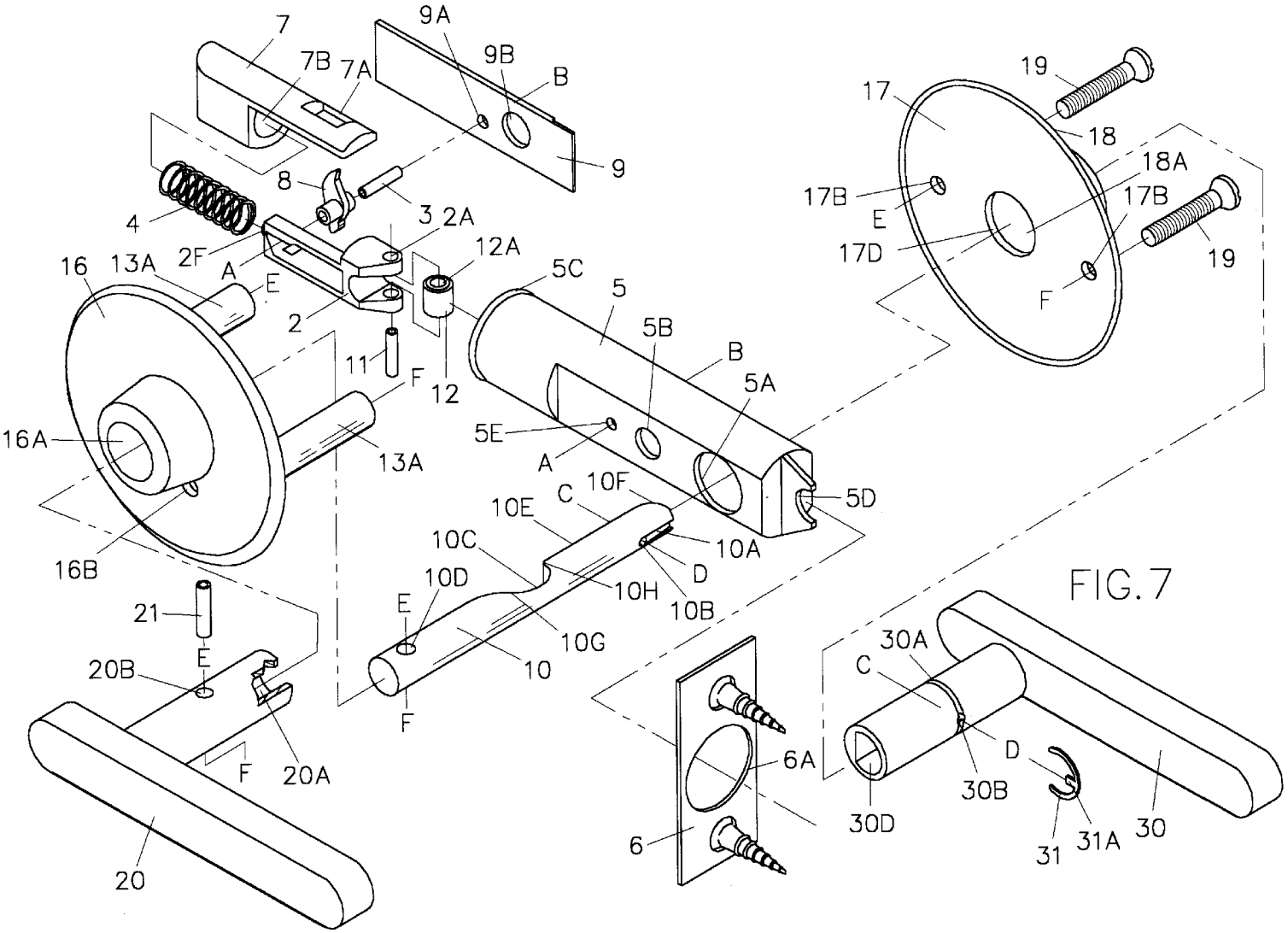
FIG. 7 is an exploded view of the present invention without a locking mechanism.

As shown in FIGS. 1 and 6, in the resting position of the preferred embodiment of the present invention, the rotating cam follower 12 is in the saddle 10C of the bar 10.

Figure 9:
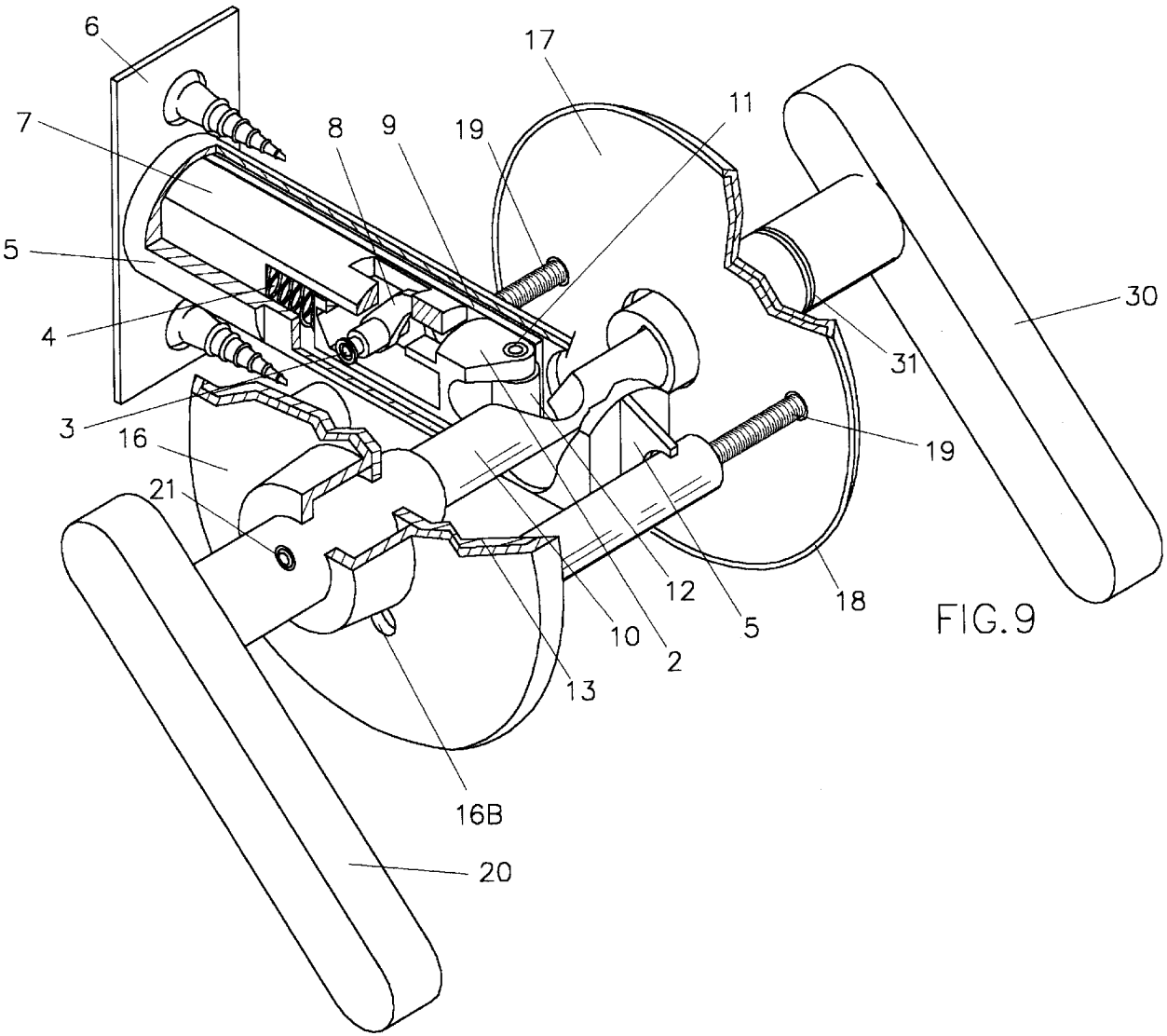
FIG. 9 shows the present invention with the bolt retracted by a rotary motion of a handle.

As shown in FIG. 9, when the bar 10 is rotated, the effect on the receiver 2 is the same as if the bar cam surface 10G is pushed, or pulled, into the rotating cam follower 12. When the bar 10 is rotated, as opposed to being pushed or pulled, the saddle 10C, being a part of the bar 10, also rotates. As the saddle 10C rotates, an edge of the saddle 10C contacts one of the lugs 2E of the receiver 2, forcing the receiver 2 towards the spring 4. The receiver edge 2D forces the ear 8B of the internal lever 8 to rotate, and the bolt 7 is pulled into the barrel housing 5 by the lever 8 which rides inside the bolt lever slot 7A. So, if one trying to open a door becomes confused, and doesn't push on the exterior handle 20 to open the door away from oneself, or pull on the interior handle 30 to open the door towards oneself, and instead tries to turn the exterior handle 20 or the interior handle 30, the result is the same! Hence the present invention is an improvement over the previously mentioned patent, Baker U.S. Pat. No. 5,516,163, Single Motion, Quick Release Latch Mechanism.

When the latch mechanism is installed in a door and the door is opened or closed and the handle is released, the latch mechanism returns to the at rest position with the spring 4 biasing the bolt 7 back to the extended position.

The exterior handle outer plate 16 includes an exterior handle outer plate aperture 16A and a lock disconnect aperture 16B.

As indicated in FIGS. 1, 6, 8, and 9, the exterior handle 20 and the interior handle 30 of the latch mechanism are free to rotate as well as move linearly.

The exterior handle inner plate 13 includes two internal threaded studs 13A. In the preferred embodiment of the present invention, one of the internal threaded studs 13A goes through the in-line barrel housing internally threaded stud clearances 5B, and the other internal threaded stud 13A goes through the barrel housing bracket 5D, so that the barrel housing 5 is secured in a static position. The screws 19 secure the interior handle inner plate 17 and the interior handle outer plate 18 in position. The interior handle 30 goes through a clearance 18A in the interior handle outer plate 18 and also through an interior handle interior plate clearance 17D in the interior handle inner plate 17.

Doorknob latching mechanisms can be classified as either a privacy or a passage version. The privacy version has a lock that would be used on a bedroom or bathroom door that could be actuated from inside the room. The passage version, which does not contain a lock, would typically be used on a closet door.

The present invention includes an optional privacy lock.

As shown in FIG. 2, the interior handle inner plate 17 includes two lock plate guides 17A, screw apertures 17B, lock knob aperture 17C, and interior handle interior plate clearance 17D.

The lock plate 14 includes a lock tang 14A, lock disconnect tabs 14B, and a lock plate aperture 14C. The lock knob 15 fits into the lock plate aperture 14C and is secured to the lock plate 14 in an appropriate manner such as by heading the lock knob 15 so it is attached to the lock plate 14, or it can be threaded into the lock plate 14, or by any other method known to those skilled in the state of the art.

Referring to FIG. 1, the lock plate 14 is retained within the lock plate guides 17A in such a manner that the lock plate 14 slides horizontally with respect to the interior handle inner plate 17. The lock tang 14A engages an interior handle lock aperture 30C to prevent the bar 10 from being pushed, pulled, or turned, thus creating a privacy lock. In the preferred embodiment of the present invention, the lock tang 14A has a keystone shape and the interior handle lock aperture 30C has matching slope sides to make a more secure privacy lock than would be the case if the sides of the lock tang 14A and the interior handle lock aperture 30C were parallel. The purpose of the lock disconnect tabs 14B is to permit the use of the part 40, when part end 40A is inserted through the lock disconnect aperture 16B, to slide the lock plate 14 disengaging the lock tang 14A from the interior handle lock aperture 30C now permitting the bar 10 to move freely.

In the preferred embodiment of the present invention the parts typically would be steel or brass except some parts, such as the barrel housing 5 and the bar 10 could be a nylon or an equivalent plastic.

As can be seen from FIG. 8, when the bar cam surface 10G is forced against the rotating cam follower 12, both the rotating cam follower 12 and the receiver 2 are moved towards the internal lever 8. Due to the linear motion, the receiver 2 is forced against the barrel housing 5. If the barrel housing 5 is of plastic, then the internal stationary plate 9 is necessary to insure a long life and a trouble free latch mechanism. The preferred material of the internal stationary plate 9 is stainless steel.

FIG. 8 illustrates the exterior handle 20 moved towards the exterior handle outer plate 16 which would abut the exterior surface of a door. When the exterior handle 20 is so moved, as shown in FIG. 8, the bar 10 has shifted so the bar cam surface 10G (Ref. FIG. 5A), has contacted the rotating cam follower 12, which is affixed in the receiver 2, yet able to rotate around the stationary pin 11, moving the receiver 2 which rotates the internal lever 8 which in turn retracts the bolt 7 into the barrel housing 5. The rotating action of the rotating cam follower 12, minimizes friction and wear on the bar cam surface 10G. Minimizing friction reduces internal forces involved in actuating the latch mechanism, therefore extending the life of the present invention.

FIG. 9 illustrates that rotation of a handle produces the same end result as shown in FIG. 8 when a handle is linearly actuated.

The preferred embodiment of the present invention has the bolt 7 which extends into a prior art strike plate with a strike plate tang that has a slight angle that encourages ease of linear motion. This prior art strike plate is shown and described in the prior art Baker U.S. Pat. No. 5,516,163.

The bar cam surface 10G and the saddle 10C co-operating with the rotating cam follower 12 centers the bar 10 in its at rest position in the barrel housing 5. As the door handle plates do not restrict either the rotation or linear movement of the handles, a given bar 10 length can be used with a range of different door thicknesses.

In the preferred embodiment shown, to minimize internal friction and wear, thus minimizing effort required to actuate, while extending the useful life of the mechanism, appropriate lubrication, including dry film lubricants, iron or tin phosphate coatings, teflon coatings, and other means, obvious to those skilled in the state of the art will be utilized on the various points of contact within the Dual Motion, Quick Release Latch Mechanism.

Although the description above contains many specificities, these should not be construed as limiting the scope of the invention but merely providing illustrations of some of the presently preferred embodiments of this invention. For example, a non-rotating cam follower could be substituted for the rotating cam follower, although ease of motion and wear resistance would be affected. Also, while the invention is primarily intended for doors, it is also applicable to gates, drawers, and a variety of other types of closures or in places where a Dual Motion, Quick Release Latch Mechanism with low actuating force is desirable.

Thus the scope of the invention should be determined by the appended claims and their legal equivalents rather than by the examples given.

I claim:

1. A latch mechanism comprising:

a) a bolt movable between retracted and extended positions mounted in a recess in a door with an exterior and an interior surface said latch mechanism cooperating with a strike plate in the extended position said strike plate mounted in a recess in a door frame;

b) an exterior handle mounted on the exterior surface of said door;

c) an interior handle mounted on the interior surface of said door;

d) a bar having a linear axis and mounted for rotational and for linear movement about said axis and having a cam surface wherein the bar extends through the recess in the door and is attached to the exterior and interior handles;

e) a receiver with a cam follower in contact with said cam surface, wherein the receiver is actuated by the bar when said handles are moved in a linear direction along said axis, wherein the receiver is further actuated by the bar when said handles are moved rotationally about said axis;

f) a lever with an ear mounted inside a barrel housing by a rivet wherein the barrel housing guides said receiver and bolt wherein an edge on the receiver will contact the ear of the lever causing the lever to rotate about the rivet within a bolt lever slot in said bolt, retracting the bolt into the barrel housing from the strike plate;

g) a spring contained within the barrel housing between the bolt and the receiver;

h) an exterior plate with internally threaded studs secured to an interior plate with screws through the barrel housing apertures and a bracket; and i) a slidable lock plate with a lock tang that can engage an interior handle lock aperture providing a means of locking said bolt, said lever, and said receiver against said linear and against said rotational movement of said handles.

2. The latch mechanism of claim 1 where the cam follower is a rotating cam follower mounted on said receiver that contacts said cam surface reducing friction and wear from said linear movement of said bar.

3. The latch of claim 2 wherein the bar includes a saddle that cooperates with said rotating cam follower mounted on said receiver to linearly and rotationally position the bar.

4. The latch mechanism of claim 3 wherein the bar with a cam surface further comprises a bar assembly cam radius between the saddle and a bar flat, said cam surface and said bar assembly cam radius centering the rotating cam follower mounted on the receiver in the saddle of the bar in the at rest position.

5. The latch mechanism of claim 4 wherein the bar further comprises a bar radius to facilitate installation of the bar through the barrel housing and past the receiver with the rotating cam follower.

6. The latch mechanism of claim 1 wherein the bar further comprises an inclined bar tang guide, a bar flat and a bar tang aperture which both facilitate the installation of the interior handle with a locking ring and also allow a means for disconnecting the interior handle and the locking ring from the bar.

7. The latch mechanism of claim 1 wherein the bar further comprises a saddle with at least one edge that contacts a fixed lug on the receiver when the bar is rotated, by turning a handle and thus centering the receiver in the saddle of the bar.

8. The latch mechanism of claim 2 wherein the receiver further comprises lug ends cut at an angle which allow the bar cam surface to linearly contact the rotating cam follower on the receiver.

9. The latch mechanism of claim 2 wherein the receiver has apertures containing a stationary pin, about which the rotating cam follower rotates.

10. The latch mechanism of claim 6 wherein the interior handle further comprises an interior handle locking ring clearance and an interior handle aperture to hold the locking ring in place on the interior handle.

11. The latch mechanism of claim 6 wherein the locking ring further comprises a locking ring tang which, when aligned with the inclined bar tang guide, allows installation of the interior handle on the bar.

12. The latch mechanism of claim 1 wherein the door handle plates includes a means allowing a range of different door thicknesses to be used with a given bar length.

13. The latch mechanism of claim 6 wherein the interior handle further comprises a bar clearance, which, when aligned with the bar flat, assures alignment of the inclined bar tang guide with the locking ring tang, which permits the locking ring tang to align with the bar tang aperture, permitting installation of the interior handle on the bar.

14. The latch mechanism of claim 1 further comprising an internal stationary plate inserted in the barrel housing, wherein the barrel housing is made of plastic.

15. The latch mechanism of claim 1 wherein the lock tang has a keystone shape, as opposed to having parallel sides, which engages an interior handle lock aperture, said interior handle lock aperture having matching slope sides, providing a more secure means for locking said handles against both linear and rotational movement.

16. The latch mechanism of claim 1 wherein the lock tang has a keystone shape which engages an interior handle lock aperture, said interior handle lock aperture having matching slope slides, providing a more secure means for locking said handles against both linear and rotational movement.

17. The latch mechanism of claim 6 wherein said lock plate further comprises a lock disconnect tab, which permits the latch mechanism to be unlocked by shifting said lock plate by means of a part inserted through a lock disconnect aperture and against the lock disconnect tab, said shifting of said lock plate disengaging the lock tang of the lock plate from the interior handle lock aperture permitting the bar to be moved both linearly and rotationally.

18. The latch mechanism of claim 1 further comprising an interior handle inner plate with lock plate guides wherein said lock plate is retained within, and said lock plate slides horizontally within, the lock plate guides.

19. The latch mechanism of claim 1 wherein the barrel housing is a barrel housing with a removable end plate.

20. The latch mechanism of claim 1 further comprising a lock knob attached to the lock plate providing a means of manually moving the lock plate horizontally.

* * * * *